US007938393B2

(12) United States Patent
Yako

(10) Patent No.: US 7,938,393 B2
(45) Date of Patent: May 10, 2011

(54) RECORDING APPARATUS AND METHOD OF CONTROLLING THE SAME

(75) Inventor: Yasuhiro Yako, Adachi-ku (JP)

(73) Assignee: Canon Kabushiki Kaisha (JP)

( * ) Notice: Subject to any disclaimer, the term of this patent is extended or adjusted under 35 U.S.C. 154(b) by 142 days.

(21) Appl. No.: 11/273,677

(22) Filed: Nov. 14, 2005

(65) Prior Publication Data

US 2006/0180975 A1 Aug. 17, 2006

(30) Foreign Application Priority Data

Nov. 12, 2004 (JP) ..... 2004-329790

(51) Int. Cl.
*B65H 3/44* (2006.01)

(52) U.S. Cl. ..... 271/9.09; 271/9.13; 271/258.01

(58) Field of Classification Search ..... 271/9.01, 271/9.09, 9.13, 258.01, 259, 258.03
See application file for complete search history.

(56) References Cited

U.S. PATENT DOCUMENTS 5,159,387 A * 10/1992 Takahashi et al. ..... 355/50
5,228,680 A * 7/1993 Sugiura ..... 271/259
5,585,943 A * 12/1996 Kikuchi ..... 358/498
5,652,943 A * 7/1997 Matsuo ..... 399/21
6,244,594 B1 * 6/2001 Araseki et al. ..... 271/293

FOREIGN PATENT DOCUMENTS

JP 10-200686 A 7/1998

* cited by examiner

*Primary Examiner* — Michael C McCullough
(74) *Attorney, Agent, or Firm* — Rossi, Kimms & McDowell LLP

(57) ABSTRACT

A recording apparatus includes a facsimile receiving function and one of a copy function and a printer function. On a shared sheet conveying path, sheets fed from a manual feed port and a cassette feed port are conveyed, and conveying rollers hold the sheet from the manual feed port in a removable state and is capable of conveying the sheet from the cassette feed port when no sheet from the manual feed port is being held. A memory is operable when image formation is not possible for an image received by the facsimile receiving function, to store the received image. It is detected that a sheet from the manual feed port is being held on the sheet conveying path when image formation for the received image is to be carried out on a sheet in the cassette feed port, a warning is given to have the held sheet removed.

2 Claims, 14 Drawing Sheets

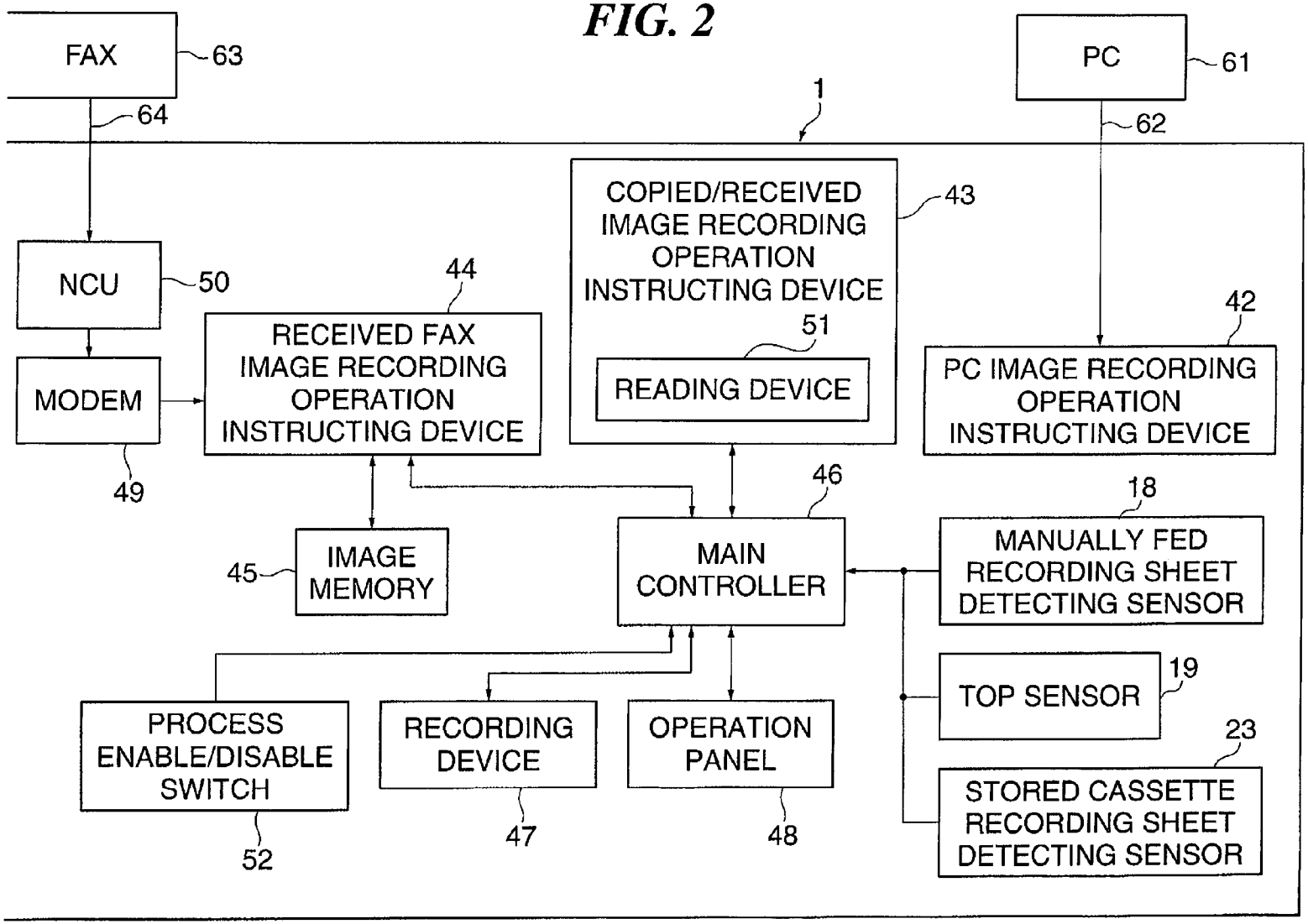
FIG. 2
1
PC
61
62
FAX
63
64
NCU
50
MODEM
49
RECEIVED FAX IMAGE RECORDING OPERATION INSTRUCTING DEVICE
44
IMAGE MEMORY
45
COPIED/RECEIVED IMAGE RECORDING OPERATION INSTRUCTING DEVICE
43
READING DEVICE
51
PC IMAGE RECORDING OPERATION INSTRUCTING DEVICE
42
MAIN CONTROLLER
46
MANUALLY FED RECORDING SHEET DETECTING SENSOR
18
TOP SENSOR
19
STORED CASSETTE RECORDING SHEET DETECTING SENSOR
23
OPERATION PANEL
48
RECORDING DEVICE
47
PROCESS ENABLE/DISABLE SWITCH
52

RECORDING APPARATUS AND METHOD OF CONTROLLING THE SAME

BACKGROUND OF THE INVENTION

1. Field of the Invention

The present invention relates to a recording apparatus including a plurality of sheet feed ports with a shared conveying path and a method of controlling the same.

2. Description of the Related Art

In recent years, there has been remarkable development in so-called "multi-function peripherals" (MFPs) which carry out a copy function, a printer function for printing image data or the like outputted from a personal computer (PC), and a facsimile (hereinafter simply "fax") function by a single recording apparatus.

MFPs can record images on recording sheets in copy mode, printer mode, and facsimile rode (fax mode). An MFP is normally equipped with a plurality of sheet feed ports for feeding recording sheets. Generally, one out of the plurality of sheet feed ports is a so-called "manual feed port" that enables an operator to select and set a desired type of recording sheet for each image recording, while the other sheet feed ports are so-called "cassette feed ports" in which a comparatively large number of recording sheets are stored.

A construction for an MFP is known in which a conveying path for recording sheets fed from the respective sheet feed ports is shared to reduce the number of sheet feeding rollers for feeding sheets and discharge rollers for discharging sheets, resulting in reduced apparatus size. Reductions in apparatus size are desired since MFPs are often installed in offices with limited space.

With a conventional MFP, while image information transmitted from a personal computer is being recorded in printer mode, for example, it is not possible to record fax image information transmitted by fax. In this case, the received fax image information is stored in an image memory, and when the recording in printer mode is completed, the image information is read out from the image memory and corresponding images are recorded on recording sheets.

As mentioned above, in an MFP where a conveying path is shared by recording sheets fed from the cassette feed ports and recording sheets fed from the manual feed port, when a sheet is manually set in the manual feed port and present on the shared conveying path, it will not be possible to feed a recording sheet (a "cassette-fed recording sheet") from any of the cassette feed ports.

A communication protocol for fax communication is prescribed that the receiver should inform the transmitter of a sheet size of its recording sheets in advance and the transmitter transmits images in accordance with the sheet size.

Also, since the sheet size of a manually fed recording sheet is set by the operator whenever image recording is carried out, the sheet size does not always match the sizes of the cassette-fed recording sheets.

When a manually fed recording sheet is present on the shared conveying path, since the sheet sizes of the manually fed recording sheet and the cassette-fed recording sheets may not match as mentioned above, even if fax image information is received, it will not be possible to convey a cassette-fed recording sheet from a cassette feed port or to record a received image corresponding to the fax image information onto a cassette-fed recording sheet.

In a conventional MFP, in such situation, the received fax image information is stored in the image memory and the recording of images in fax mode is put on standby until it becomes possible to feed a sheet from a cassette sheet feed port (see Japanese Laid-Open Patent Publication (Kokai) No. H10-200686, for example).

However, when the data size of the received fax image information is larger than the maximum storage capacity of the image memory, the image memory will not be able to store all of the fax image information.

Thus, there is the problem that the MFP will become unable to receive fax image information being transmitted and the reception of the fax image information will be interrupted.

SUMMARY OF THE INVENTION

It is an object of the present invention to provide a recording apparatus that is capable of preventing the reception of image information for images to be recorded from being interrupted, and a method for controlling the same.

To attain the above object, in a first aspect of the present invention, there is provided a recording apparatus including a facsimile receiving function and one of a copy function and a printer function, comprising a first sheet feeding section that feeds a manually fed sheet, a second sheet feeding section that feeds a recording sheet from a cassette that stores a plurality of recording sheets, a shared sheet conveying section on which a sheet fed from the first sheet feeding section and a sheet fed from the second sheet feeding section are conveyed, the sheet conveying section including a holding function that holds the sheet fed from the first sheet feeding section in a removable state and capable of conveying the sheet fed from the second sheet feeding section in a state where no sheet fed from the first sheet feeding section is being held, a sensor that detects whether a sheet is being held on the sheet conveying section, an image forming section that forms images on the sheets fed by the first sheet feeding section and the second sheet feeding section, a memory operable when image formation by the image forming section is not possible for an image received by the facsimile receiving function, to store the received image, and a warning section operable when the sensor detects that a sheet fed from the first sheet feeding section is being held on the sheet conveying section when image formation for the received image is to be carried out on a sheet stored in the second sheet feeding section, to give a warning so as to have the held sheet removed.

Preferably, the recording apparatus further comprises a recording control section operable when the sensor detects that the sheet has been removed from the sheet conveying section, to have image formation commenced for the received image stored in the memory.

Preferably, the recording apparatus further comprises a discharge control section operable when the sheet held on the sheet conveying section has not been removed after a predetermined time period has elapsed following the warning given by the warning section, to discharge the held sheet.

To attain the above object, in a second aspect of the present invention, there is provided a recording apparatus including a facsimile receiving function and one of a copy function and a printer function, comprising a first sheet feeding section that feeds a manually fed sheet, a second sheet feeding section that feeds a recording sheet from a cassette that stores a plurality of recording sheets, a shared sheet conveying section on which a sheet fed from the first sheet feeding section and the sheet fed from the second sheet feeding section are conveyed, the sheet conveying section including a holding function that holds the sheet inserted from the first sheet feeding section in a removable state and capable of conveying the sheet fed from the second sheet feeding section in a state where no sheet fed from the first sheet feeding section is being held, a sensor that detects whether a sheet is being held on the sheet conveying section, an image forming section that forms images on the sheets fed by the first sheet feeding section and the second sheet feeding section, a memory operable when image formation by the image forming section is not possible for an image received by the facsimile receiving function, to store the received image, and a discharge control section operable when the sensor detects that a sheet fed from the first sheet feeding section is being held on the sheet conveying section when image formation for the received image is to be carried out on a sheet stored in the second sheet feeding section, to discharge the held sheet without image formation being carried out thereon.

Preferably, the recording apparatus further comprises a recording control section operable after the sheet has been discharged by the discharge control section, to have image formation commenced for the received images stored in the memory.

Preferably, the discharge control section discharges the sheet toward the first sheet feeding section.

To attain the above object, in a third aspect of the present invention, there is provided a recording apparatus comprising a sheet feeding device that includes a plurality of sheet feed ports and feeds recording sheets from the respective sheet feed ports, a conveying device including a shared conveying path for the recording sheets respectively fed from the plurality of sheet feed ports, a sheet feed port designating device that designates one sheet feed port out of the plurality of sheet feed ports of the sheet feeding device to feed a recording sheet from the designated sheet feed port by the sheet feeding device, a recording device that records an image on a recording sheet, and a control device operable when the recording device is to record images on recording sheets and a recording sheet has been set in another sheet feed port that is not sheet feed port designated by the sheet feed port designating device, to give an instruction to remove the recording sheet set in the other sheet feed port.

Preferably, the recording apparatus further comprises a switch that is capable of inhibiting the control device from give the instruction to remove the recording sheet set in the other sheet feed port should be removed.

To attain the above object, in a fourth aspect of the present invention, there is provided a recording apparatus comprising a sheet feeding device that includes a manual sheet feed port and a cassette sheet feed port, a manual sheet feed port recording sheet detecting device and a cassette sheet feed port recording sheet detecting device that respectively detect whether a recording sheet is set in the manual sheet feed port and the cassette sheet feed port, a feeding roller that is shared by the manual sheet feed port and the cassette sheet feed port, a recording device that records an image on the recording sheet, a receiving device that receives an image, an image memory device operable when the image received by the receiving device cannot be recorded by the recording device, to store the received image, a sheet feed port designating device that designates one out of the manual sheet feed port or the cassette sheet feed port, a notifying device, and a manual sheet feed port recording sheet removal instructing device operable when the recording device is to record the image on the recording sheet set in the cassette sheet feed port and the recording sheet is set in the manual sheet feed port, to give an instruction, via the notifying device, to the operator to remove the recording sheet set in the manual sheet feed port.

Preferably, the recording device further comprises a manual sheet feed port recording sheet discharging device that discharges the recording sheet set in the manual sheet feed port.

More preferably, the recording apparatus further comprises a timer that counts a time period equivalent to a set timer value for a predetermined time period, when recording of the image on the recording sheet by the recording device is not carried out during count of the timer value for the predetermined time period by the timer after the manual sheet feed port recording sheet removal instructing device giving the instruction to remove the recording sheet set in the manual sheet feed port, the manual sheet feed port recording sheet discharging device discharges the recording sheet set in the manual sheet feed port after the predetermined time period has elapsed and the manual sheet feed port recording sheet removal instructing device instructs, via the notifying device, to the operator that the recording sheet set in the manual sheet feed port has been removed.

Further preferably, when the manual sheet feed port recording sheet detecting device has detected that the recording sheet is not set in the manual sheet feed port after the manual sheet feed port recording sheet removal instructing device has given the instruction to remove the recording sheet set in the manual sheet feed port or after the manual sheet feed port recording sheet discharging device has discharged the recording sheet set in the manual sheet feed port, the manual sheet feed port recording sheet removal instructing device stops the instruction to remove the recording sheet from the manual sheet feed port.

Also further preferably, the recording apparatus further comprises a timer value setting device that is capable of setting a plurality of timer values as the timer value in the timer.

Still preferably, when the recording device records the image on the recording sheet during a predetermined time period, the timer value setting device sets a timer value as the timer value out of the plurality of timer values that is shorter than a predetermined timer value.

Also preferably, the recording apparatus further comprises a switch that inhibits the manual sheet feed port recording sheet removal instructing device from giving the instruction, via notifying device, to the operator to remove the recording sheet set in the manual sheet feed port, the manual sheet feed port recording sheet discharging device from discharging the recording sheet set in the manual sheet feed port, the timer from counting an elapsing of a time period for the set timer value, and the timer value setting device from setting the plurality of timer values as the timer value set in the timer.

To attain the above object, in a fifth aspect of the present invention, there is provided a recording apparatus comprising a sheet feeding device that includes a manual sheet feed port and a cassette sheet feed port, a manual sheet feed port recording sheet detecting device and a cassette sheet feed port recording sheet detecting device that respectively detect whether a recording sheet is set in the manual sheet feed port and the cassette sheet feed port, a feeding roller that is shared by the manual sheet feed port and the cassette sheet feed port, a manual sheet feed port recording sheet holding device operable when the manual sheet feed port recording sheet detecting device has detected the recording sheet, to cause the feeding roller to rotate for a predetermined time period to hold the recording sheet at the manual sheet feed port, a recording device that records an image on the recording sheet, a receiving device that receives an image, an image memory device operable when the image received by the receiving device cannot be recorded by the recording device, to store the received image, a sheet feed port designating device that designates one out of the manual sheet feed port or the cassette sheet feed port, a notifying device, and a manual sheet feed port recording sheet removal instructing device that gives an instruction, via the notifying device, to the operator to remove the recording sheet set in the manual sheet feed port, wherein when the manual sheet feed port recording sheet detecting device detects a recording sheet while the recording device is recording the image on a recording sheet fed from the cassette sheet feed port, the sheet feeding device stops a feeding operation for recording sheets, the manual sheet feed port recording sheet removal instructing device gives the instruction, via the notifying device, to the operator to remove the recording sheet from the manual sheet feed port, the image memory device stores the image until the recording sheet set in the manual sheet feed port has been removed, the manual sheet feed port recording sheet removal instructing device stops the instruction to remove the recording sheet set in the manual sheet feed port when the recording sheet has been removed, and the sheet feeding device restarts the feeding operation for the recording sheets fed from the cassette sheet feed port.

Preferably, the recording apparatus further comprises a timer that counts a time period equivalent to a set timer value for a predetermined time period, and a manual sheet feed port recording sheet discharging device that discharges the recording sheet set in the manual sheet feed port, the manual sheet feed port recording sheet discharging device discharges the recording sheet set in the manual sheet feed port after the timer has counted the timer value for the predetermined time period, the manual sheet feed port recording sheet removal instructing device stops the instruction to remove the recording sheet set in the manual sheet feed port after the recording sheet has been removed, and the sheet feeding device restarts the feeding operation for the recording sheets fed from the cassette sheet feed port.

Also preferably, the recording device further comprises a switch that inhibits the timer from counting the time period for the set timer value, and the manual sheet feed port recording sheet discharging device from discharging the recording sheet set in the manual sheet feed port.

To attain the above object, in a sixth aspect of the present invention, there is provided a control method for a recording apparatus including a sheet feeding device that includes a plurality of sheet feed ports and feeds recording sheets from the respective sheet feed ports, a conveying device including a shared conveying path for the recording sheets respectively fed from the plurality of sheet feed ports, a sheet feed port designating device that designates one sheet feed port out of the plurality of sheet feed ports of the sheet feeding device, and a recording device that records an image on the recording sheets, wherein the sheet feeding device feeds the recording sheet from the sheet feed port designated by the sheet feed port designating device, the control method comprising a step of instructing, when the recording device is to record images on the recording sheets and a recording sheet has been set in another sheet feed port that is not the sheet feed port designated by the sheet feed port designating device, that the recording sheet set in the other sheet feed port should be removed.

To attain the above object, in a seventh aspect of the present invention, there is provided a control method for a recording apparatus including a sheet feeding device that includes a manual sheet feed port and a cassette sheet feed port, a manual sheet feed port recording sheet detecting device and a cassette sheet feed port recording sheet detecting device that respectively detect whether a recording sheet is set in the manual sheet feed port and the cassette sheet feed port, a feeding roller that is shared by the manual sheet feed port and the cassette sheet feed port, a recording device that records an image on the recording sheet, a receiving device that receives an image, an image memory device operable when the image received by the receiving device cannot be recorded by the recording device, to store the received image, and a sheet feed port designating device that designates one out of the manual sheet feed port and the cassette sheet feed port, the control method comprising a step of giving, when the recording device is to record an image on a recording sheet set in the cassette sheet feed port in a state where a recording sheet is set in the manual sheet feed port, an indication to the operator to remove the recording sheet from the manual sheet feed port.

According to the present invention, it is possible to prevent the reception of image information for images to be recorded from being interrupted.

The above and other objects, features, and advantages of the invention will become more apparent from the following detailed description taken in conjunction with the accompanying drawings.

BRIEF DESCRIPTION OF THE DRAWINGS

FIG. 2 is a block diagram schematically showing the electrical construction of an MFP as the recording apparatus shown in FIG. 1;

DETAILED DESCRIPTION OF THE PREFERRED EMBODIMENTS

The present invention will now be described in detail below with reference to the drawings showing a preferred embodiment thereof.

Figure 1:
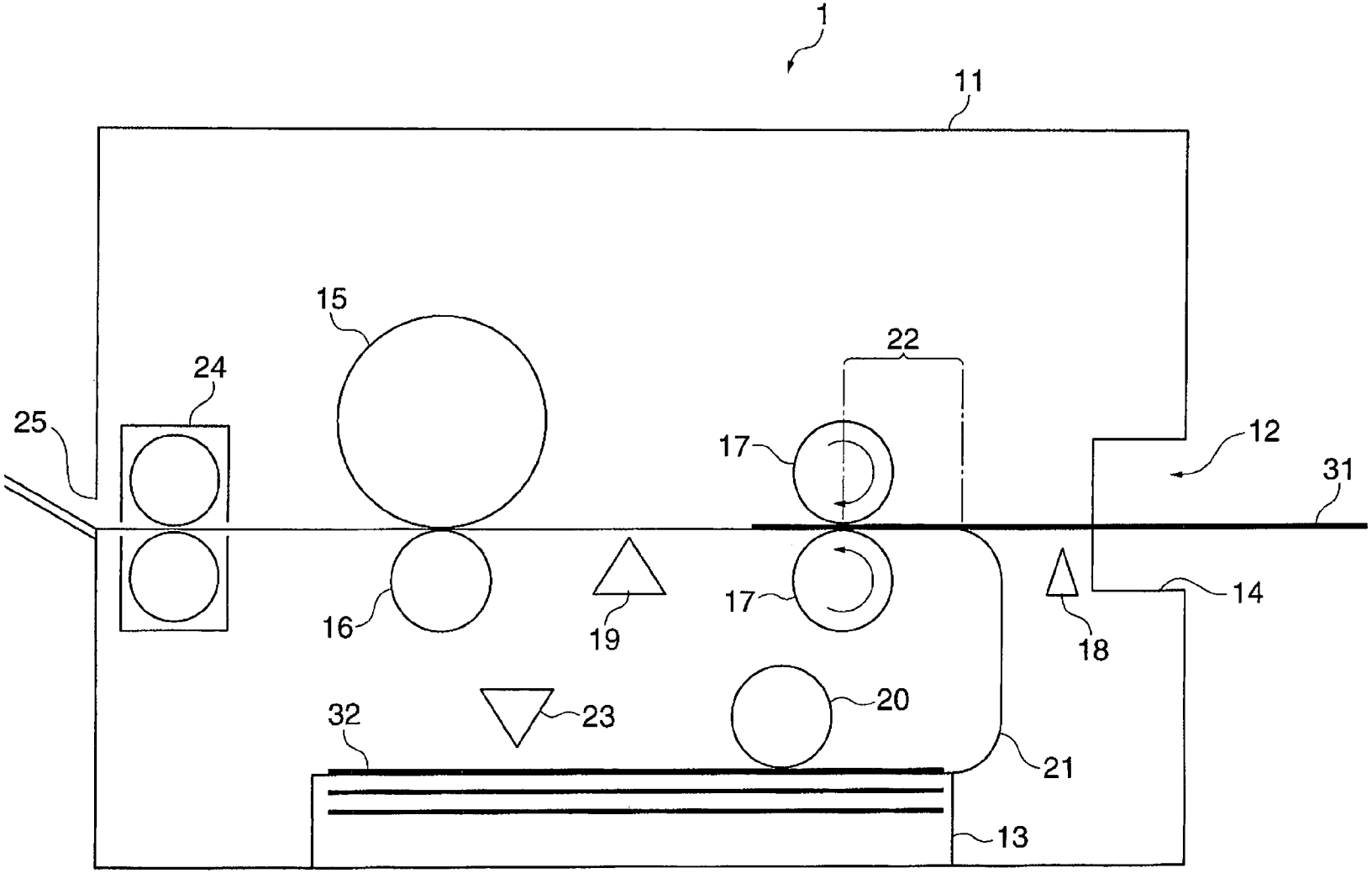
FIG. 1 is a cross-sectional view schematically showing the construction of a recording apparatus according to an embodiment of the present invention.

FIG. 1 is a cross-sectional view schematically showing the construction of a recording apparatus according to an embodiment of the present invention.

As shown in FIG. 1, an MFP 1 as the recording apparatus according to the present embodiment includes a main unit 11 as a housing. A manual feed port 12 is provided in a front wall (the right side as viewed in FIG. 1) of the main unit 11 and a cassette feed port 13 is provided at a lower part of the main unit 11. The manual feed port 12 includes an opening 14, which is formed in the main unit 11 and allows the operator to insert a recording sheet therethrough, but does not have a recording sheet tray on which recording sheets can be placed.

The MFP 1 includes a photosensitive drum 15, a transfer roller 16, and a pair of conveying rollers 17, which are provided inside the main unit 11. The photosensitive drum 15, the transfer roller 16, and the pair of conveying rollers 17 are disposed such that the nip between the photosensitive drum 15 and the transfer roller 16, the nip of the conveying rollers 17, and the opening 14 are at the same height in a vertical direction with respect to the main unit 11. The MFP 1 also includes a manually fed recording sheet detecting sensor 18, and a vertical synchronization detecting sensor (hereinafter "TOP sensor") 19. The manually fed recording sheet detecting sensor 18 is disposed near the opening 14 at a location between the conveying rollers 17 and the opening 14. The TOP sensor 19 is disposed at a location between the photosensitive drum 15 and the conveying rollers 17.

When a recording sheets 31 has been inserted by the operator into the manual feed port 12, the manually fed recording sheet detecting sensor 18 detects that a manually fed recording sheet 31 has been inserted into the manual feed port 12. When the manually fed recording sheet detecting sensor 18 detects that a manually fed recording sheet 31 has been inserted into the manual feed port 12, the conveying rollers 17 rotate for a predetermined time period so that the manually fed recording sheet 31 fed from the manual feed port 12 is nipped at the nip of the conveying rollers 17. In this way, the MFP 1 is constructed such that a single recording sheet 31 can be held even if the manual feed port 12 does not have a recording sheet tray.

The manually fed recording sheet 31 nipped by the conveying rollers 17 is conveyed toward the photosensitive drum 15 by forward rotation of the conveying rollers 17 (rotation in the direction shown by the arrow in FIG. 1). When the TOP sensor 19 detects the leading edge of the manually fed recording sheet 31, the photosensitive drum 15 and the transfer roller 16 are rotated based on the detection of the leading edge and a developer image formed on the photosensitive drum 15 is transferred onto the manually fed recording sheet 31 by the transfer roller 16. After this, the developer image is fixed by a fixer 24, and the manually fed recording sheet 31 on which the image has been recorded is discharged out of the main unit 11 from a discharge port 25.

The MFP 1 includes a cassette feeding roller 20 disposed near an upper part of the cassette feed port 13, a sheet feeding path 21 disposed near the cassette feeding roller 20, and a stored cassette recording sheet detecting sensor 23 that is disposed near an upper part of the cassette feed port 13 and can detect how many cassette-fed recording sheets 32 are stored in the cassette feed port 13, all of the components being provided inside the main unit 11.

The cassette feeding roller 20 feeds the cassette-fed recording sheets 32 stored in the cassette feed port 13 one sheet at a time to the sheet feeding path 21. The cassette-fed recording sheets 32 are conveyed via the sheet feeding path 21 to the conveying rollers 17.

The sheet feeding path 21 connects a conveying path between the conveying rollers 17 and the manual feed port 12 to the cassette feed port 13. Accordingly, part of the conveying path between the conveying rollers 17 and the manual feed port 12 serves as a shared conveying path 22 on which both the manually fed recording sheet 31 fed from the manual feed port 12 and the cassette-fed recording sheets 32 fed from the cassette feed port 13 are conveyed.

In the same way as the manually fed recording sheet 31, a cassette-fed recording sheet 32 that has been fed from the cassette feed port 13 to the sheet feeding path 21 by the cassette feeding roller 20 and conveyed to the conveying rollers 17 is conveyed to the photosensitive drum 15 and the transfer roller 16 by the conveying rollers 17, an image is recorded thereupon, the image is fixed by the fixer 24, and then the cassette-fed recording sheet 32 is discharged from the main unit 11 through the discharge port 25.

FIG. 2 is a block diagram schematically showing the electrical construction of the MFP 1.

As shown in FIG. 2, the MFP 1 is comprised of a PC image recording operation instructing device 42 that is connected to an external PC 61 via a network 62 so as to be capable of communicating with the external PC 61, a copied/received image recording operation instructing device 43 including a reading device 51 that reads an image of an original, a received fax image recording operation instructing device 44 connected to an external facsimile machine 63 via a telephone line 64, an NCU 50, and a modem 49 so as to be capable of communicating with the facsimile machine 63, an image memory 45 connected to the received fax image recording operation instructing device 44, a recording device 47, an operation panel 48, and a main controller 46 that controls the respective devices. The image memory 45 can store received images for a plurality of pages of recording sheets.

Connected to the main controller 46 are the manually fed recording sheet detecting sensor 18, the TOP sensor 19, and the stored cassette recording sheet detecting sensor 23 so that the main controller 46 can know the detection results of the manually fed recording sheet detecting sensor 18, the TOP sensor 19, and the stored cassette recording sheet detecting sensor 23.

The PC image recording operation instructing device 42, the copied/received image recording operation instructing device 43, and the received fax image recording operation instructing device 44 respectively carry out image recording operations in printer mode, copy mode, and fax mode under the control of the main controller 46, so that image information (PC image information) received from the external PC 61 via the network 62, image information (original image information) of the original read by the reading device 51, and an image (fax image information) received from the facsimile machine 63 are recorded onto recording sheets by the recording device 47.

The operation panel 48 includes a display panel, not shown, and displays, on the display panel, a variety of information relating to operations of the MFP 1 to thereby notify the operator of the information. In addition, the operation panel 48 includes an operating section, not shown, such as a key pad, with it being possible for the operator to make various settings relating to the operations of the MFP 1 by operating the operating section.

Based on settings made in advance or set by the operator operating the operation panel 48, the main controller 46 switches the image recording mode between printer mode, copy mode, and fax mode and carries out an image recording operation in the selected mode. For example, by using the operation panel 48, it is assumed here that the operator sets that an image recording operation in fax mode should be carried out with priority over image recording operations in the other modes. When the received fax image recording operation instructing device 44 receives fax image information from the facsimile machine 63 while the MFP 1 is carrying out an image recording operation in printer mode or in copy mode, after the image recording operation being executed in printer mode or copy mode is interrupted, the operation mode is switched to fax mode and an image recording operation is carried out in fax mode.

The transmitter apparatus transmits images in accordance with the sheet size of cassette-fed recording sheets 32. Accordingly, the received fax images are recorded on the cassette-fed recording sheets 32. However, when a manually fed recording sheet 31 is present on the shared conveying path 22, it will not be possible to convey cassette-fed recording sheets 32 from the cassette feed port 13 to the photosensitive drum 15, and therefore it is not possible to record images of the received fax information on cassette-fed recording sheets 32. Also, when the sizes and/or quality of the manually fed recording sheet 31 and the cassette-fed recording sheets 32 differ, it is not preferable for the received fax images to be recorded on the manually fed recording sheet 31.

In this case, based on the detection result of the manually fed recording sheet detecting sensor 18, the main controller 46 determines whether the manually fed recording sheet 31 is present on the shared conveying path 22. When the manually fed recording sheet 31 is present on the shared conveying path 22, the main controller 46 controls the received fax image recording operation instructing device 44 to transmit the received fax image information to the image memory 45 and stores the received fax information on images in the image memory 45. The main controller 46 causes image recording in fax mode to stand by until it becomes possible to feed cassette-fed recording sheets 32 from the cassette feed port 13.

Here, in the conventional MFP, as mentioned before, when the data size of fax image information received by the received fax image recording operation instructing device 44 from the facsimile machine 63 exceeds the maximum storage capacity of the image memory 45, the image memory 45 will not be able to store all of the fax image information. Accordingly, the received fax image recording operation instructing device 44 will not be able to receive the fax image information, resulting in the problem that reception of the fax image information will be interrupted.

The MFP 1 according to the present embodiment solves the above problem with the conventional MFP by carrying out a recording sheet discharging process shown in FIGS. 3 to 10B described below.

In the following description, it is assumed that the MFP 1 according to the present embodiment is set such that images are recorded onto the cassette-fed recording sheets 32 in fax mode.

Preferred examples of the recording sheet discharging process carried out by the MFP 1 will now be described. Note that the recording sheet discharging process is executed by the main controller 46.

Figure 3:
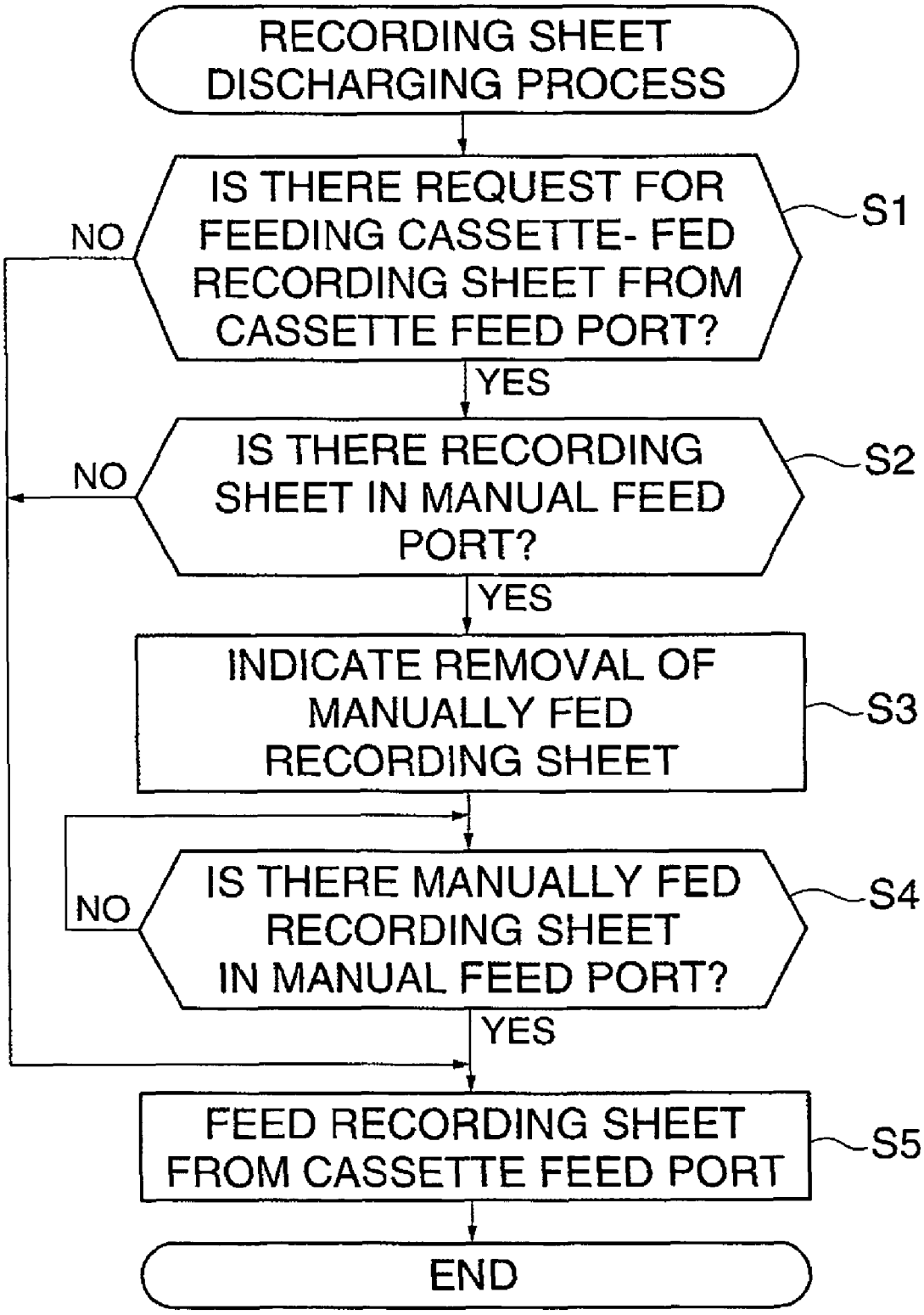
FIG. 3 is a flowchart showing the procedure of a first example of a recording sheet discharging process carried out by the MFP shown in FIG. 1.

FIG. 3 is a flowchart showing the procedure of a first example of the recording sheet discharging process carried out by the MFP 1.

First, the main controller 46 determines whether a request for feeding cassette-fed recording sheets 32 from the cassette feed port 13 has been received from the PC image recording operation instructing device 42, the copied/received image recording operation instructing device 43, or the received fax image recording operation instructing device 44 (step S1). When there has been no request for feeding cassette-fed recording sheets 32 from the cassette feed port 13, the present process is terminated. On the other hand, when there has been a feeding request for cassette-fed recording sheets 32, it is determined whether a manually fed recording sheet 31 has been inserted into the manual feed port 12 (step S2). This determination in the step S2 is made by determining whether the output from the manually fed recording sheet detecting sensor 18 indicates "ON".

When the output from the manually fed recording sheet detecting sensor 18 indicates "ON", showing that a manually fed recording sheet 31 has been inserted into the manual feed port 12, information indicating that the manually fed recording sheet 31 should be removed from the manual feed port 12 is displayed on the operation panel 48 to instruct the operator to remove the manually fed recording sheet 31 from the manual feed port 12 (step S3). Note that images received at this time are stored in the image memory 45. A warning sound may also be emitted when the indication to remove the sheet is given.

Next, sheet feeding is put on standby until the manually fed recording sheet 31 is removed from the manual feed port 12 (step S4), and when the manually fed recording sheet 31 has been removed from the manual feed port 12, that is, when the output from the manually fed recording sheet detecting sensor 18 becomes "OFF", the cassette feeding roller 20 is driven to feed cassette-fed recording sheets 32, onto which the images stored in the image memory 45 are to be recorded, from the cassette feed port 13 (step S5), and the present process is terminated.

On the other hand, when in the step S2, the output from the manually fed recording sheet detecting sensor 18 indicates "OFF", showing that no manually fed recording sheet 31 has been inserted into the manual feed port 12, the processing from the step S5 onwards is carried out. Note that in this case, the received images are not stored in the image memory 45.

According to the present process, when an image recording operation is carried out in fax mode by the received fax image recording operation instructing device 44, even if a manually fed recording sheet 31 has been inserted into the manual feed port 12 and is present on the shared conveying path 22, the operator is instructed to remove the manually fed recording sheet 31 from the manual feed port 12. Therefore, it is possible to have the manually fed recording sheet 31 removed from the shared conveying path 22 before the image memory 45 becomes full and received image information can no longer be stored.

As a result, it is possible to lower the risk of the manually fed recording sheet 31 being present on the shared conveying path 22 for a prolonged period which would result in the image memory 45 becoming unable to store all of the received image information. That is, it is possible to lower the risk of the received fax image recording operation instructing device 44 becoming unable to receive the transmitted fax image information which would result in the reception of the fax image information being interrupted.

Also, when the PC image recording operation instructing device 42 and the copied/received image recording operation instructing device 43 carry out image recording operations in printer mode and copy mode, respectively, and recording on the cassette-fed recording sheets 32 has been requested, the operator is instructed to remove the manually fed recording sheet 31 from the manual feed port 12. Accordingly, the operator can easily know that it is not possible to carry out an image recording operation in printer mode or copy mode.

Figure 4:
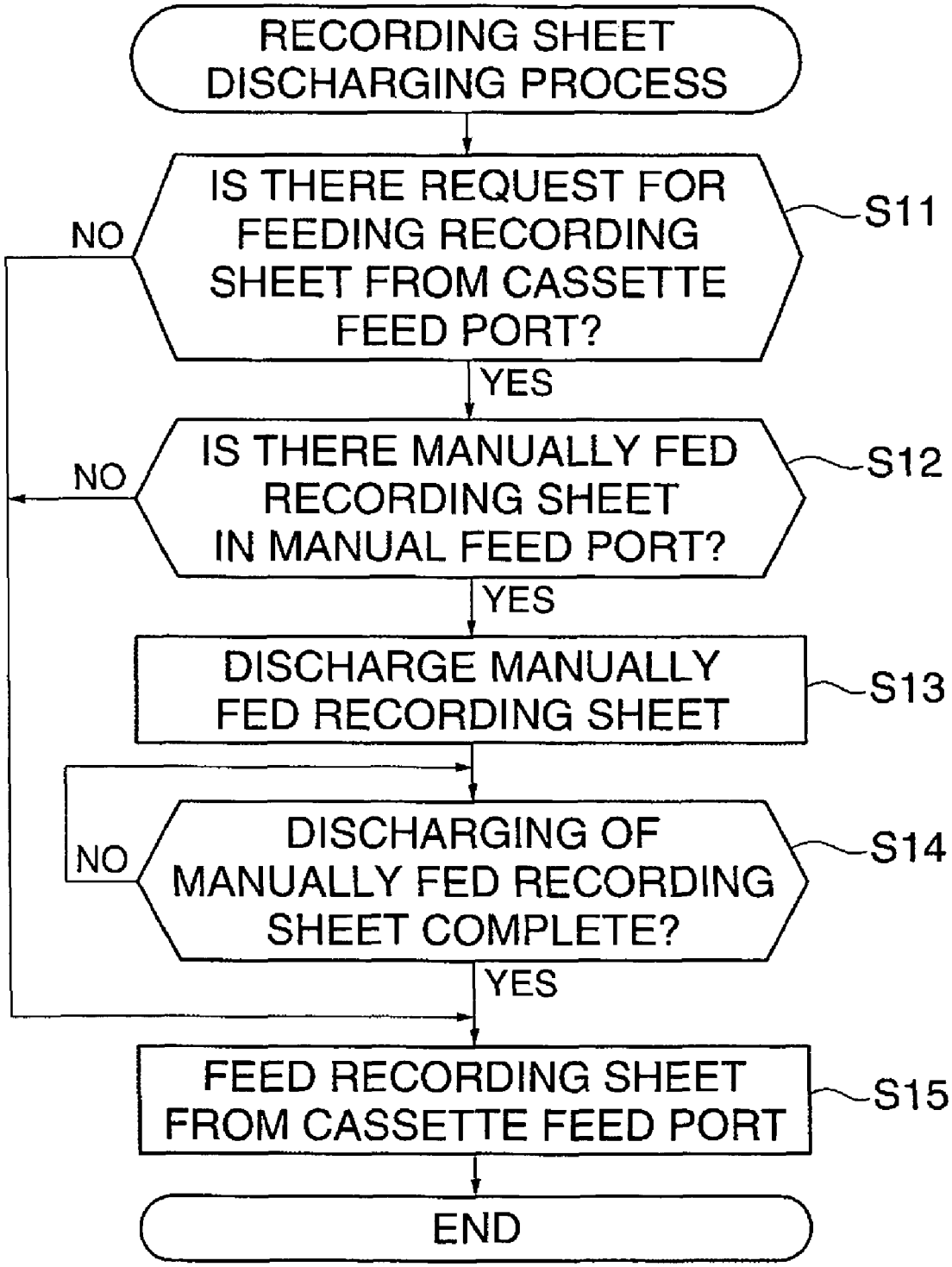
FIG. 4 is a flowchart showing the procedure of a second example of the recording sheet discharging process carried out by the MFP.

FIG. 4 is a flowchart showing the procedure of a second example of the recording sheet discharging process carried out by the MFP 1.

First, in the same way as the steps S1 and S2 in FIG. 3, it is determined whether there has been a feeding request for the cassette-fed recording sheets 32 (step S11), and when there has been no request for feeding the cassette-fed recording sheets 32, the present process is terminated. When there has been a sheet feeding request, it is determined whether a manually fed recording sheet 31 has been inserted into the manual feed port 12 (step S12). When a manually fed recording sheet 31 has been inserted into the manual feed port 12, the conveying rollers 17 are rotated in reverse to discharge the manually fed recording sheet 31 from the manual feed port 12 (step S13). Note that the images received at this time are stored in the image memory 45.

Next, the output from the manually fed recording sheet detecting sensor 18 becomes "OFF", showing that cassette-fed recording sheets 32 can be fed. That is, when the discharging of the manually fed recording sheet 31 from the manual feed port 12 is complete (step S14), the cassette feeding roller 20 is driven to feed cassette-fed recording sheets 32, onto which the images stored in the image memory 45 are to be recorded, from the cassette feed port 13 (step S15), and the present process is terminated.

On the other hand, when in the step S12, no manually fed recording sheet 31 has been inserted into the manual feed port 12, the processing from the step S15 onwards is carried out. Note that in this case, the received images are not stored in the image memory 45.

According to the present process, when the received fax image recording operation instructing device 44 carries out an image recording operation in fax mode, even if a manually fed recording sheet 31 is inserted into the manual feed port 12 and is present on the shared conveying path 22, the manually fed recording sheet 31 can be forcibly discharged from the manual feed port 12 without an image being formed thereon. Therefore, in the same way in as the first example, it can be prevented that the received fax image recording operation instructing device 44 become unable to receive the transmitted fax image information and therefore the reception of the fax image information is interrupted.

Figure 5:
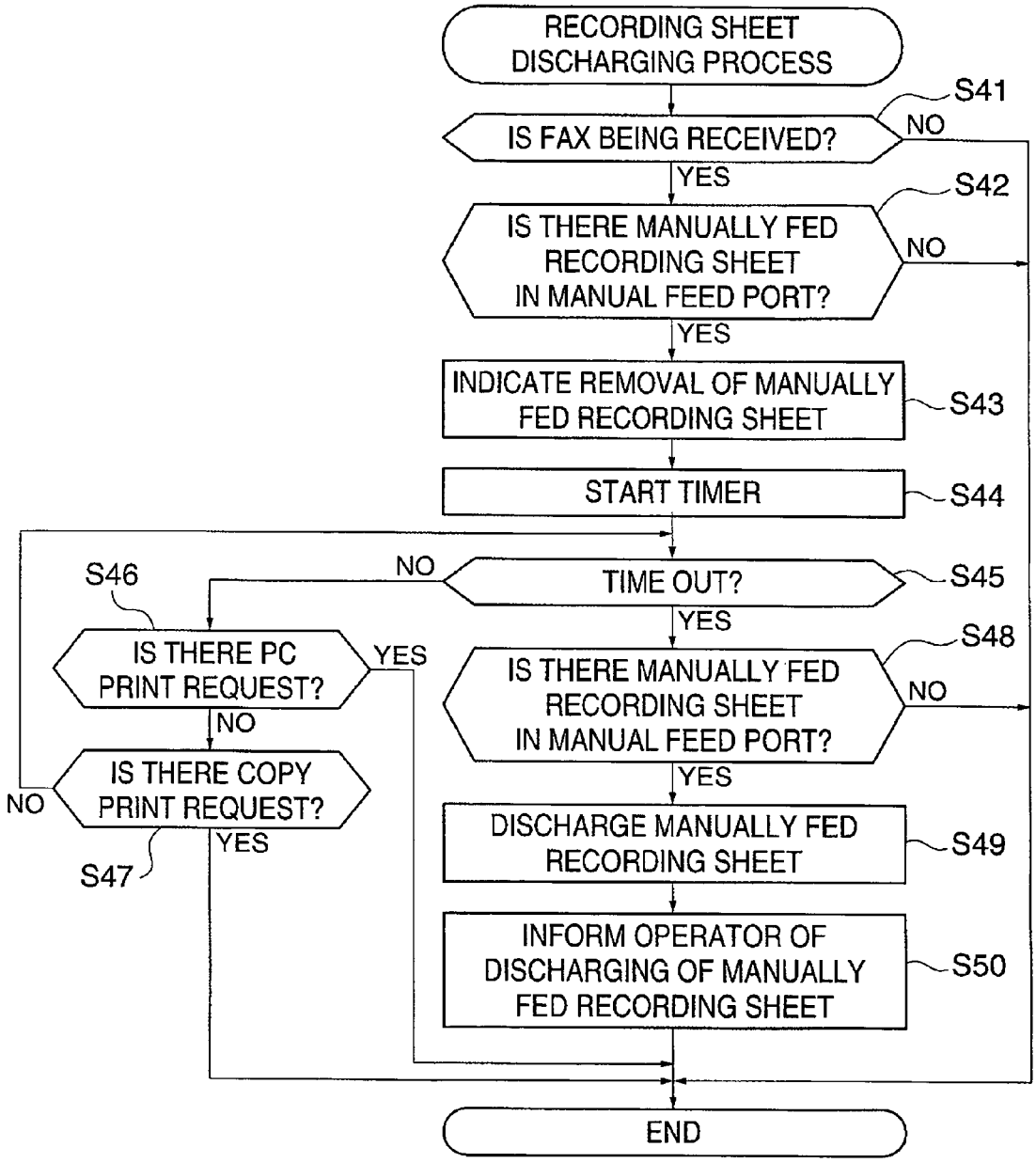
FIG. 5 is a flowchart showing the procedure of a third example of the recording sheet discharging process carried out by the MFP.

FIG. 5 is a flowchart showing the procedure of a third example of the recording sheet discharging process carried out by the MFP 1.

First, the received fax image recording operation instructing device 44 determines whether fax image information is being received from the facsimile machine 63 (step S41). When no fax image information is being received from the facsimile machine 63, the present process is terminated. On the other hand, when fax image information is being received, in the same way as the step S2 in FIG. 3, it is determined whether a manually fed recording sheet 31 has been inserted into the manual feed port 12 (step S42). When no manually fed recording sheet 31 has been inserted into the manual feed port 12, the present process is terminated. On the other hand, when a manually fed recording sheet 31 has been inserted into the manual feed port 12, information indicating that the manually fed recording sheet 31 should be removed is displayed on the operation panel 48 to instruct the operator to remove the manually fed recording sheet 31 from the manual feed port 12 (step S43). Note that the images received at this time are stored in the image memory 45.

Next, a timer, not shown, provided in the main controller 46 is activated and starts to count time (step S44). In the present embodiment, it is assumed that the above timer is a countdown timer and that the timer value is set in advance. Next, it is determined whether the timer has counted up the above timer value and reached zero, resulting in a time out (step S45).

When a time out has not occurred, it is determined whether a request for image recording in printer mode (so-called "PC print") has been received from the PC 61 (step S46). The determination in the step S46 is made according to whether the PC image recording operation instructing device 42 has received a request for image recording in printer mode from the PC 61. When there has been a PC print request, the present process is terminated. Note that the storing the images into the image memory 45 is continued.

On the other hand, when there is no PC print request in the step S46, it is determined whether there is a request for image recording in copy mode (a so-called "copy print") (step S47). The determination in the step S47 is carried out according to whether the reading device 51 in the copied/received image recording operation instructing device 43 is reading an original. When there is a copy print request, the present process is terminated. Note that the storing the images into the image memory 45 is again continued.

On the other hand, when there is no copy print request in the step S47, the process returns to the step S45 and the steps S46 and S47 are repeatedly executed until the time out occurs.

In MFPs, when a manually fed recording sheet has been set in the manual feed port, PC print or copy print is normally carried out on the manually fed recording sheet some time later. Therefore, when there has been a PC print request in printer mode ("YES" to the step S46) or when there has been a copy print request in copy mode ("YES" to the step S47), the present process is terminated without carrying out processing in a step S48 onwards, described later.

On the other hand, when it is determined in the step S45 that the timer has counted up the count value and a time out has occurred, it is determined whether the manually fed recording sheet 31 has been removed from the manual feed port 12 (the step S48) and when the manually fed recording sheet 31 has been removed from the manual feed port 12 and the output from the manually fed recording sheet detecting sensor 18 indicates "OFF", the present process is terminated. Note that in this case, recording is started for the images stored in the image memory 45. On the other hand, when the manually fed recording sheet 31 has not been removed from the manual feed port 12, the conveying rollers 17 are rotated in reverse to discharge the manually fed recording sheet 31 from the manual feed port 12 (step S49), information indicating that the manually fed recording sheet 31 has been removed from the manual feed port 12 is displayed on the operation panel 48 to inform the operator that the manually fed recording sheet 31 has been removed from the manual feed port 12 (step S50), and the present process is terminated. Note that in this case, the recording of the images stored in the image memory 45 is commenced.

According to the present process, when the received fax image recording operation instructing device 44 carries out an image recording operation in fax mode, if a manually fed recording sheet 31 is inserted into the manual feed port 12 and is present on the shared conveying path 22, the operator is instructed to remove the manually fed recording sheet 31 from the manual feed port 12. When there has been no PC print request or copy print request and the manually fed recording sheet 31 has not been removed from the manual feed port 12 even after a predetermined time period has elapsed, the manually fed recording sheet 31 is forcibly discharged from the manual feed port 12. Therefore, it is possible to reliably remove the manually fed recording sheet 31 from the shared conveying path 22 before the image memory 45 becomes full and the received image information cannot be stored in the image memory 45.

As a result, it is possible to avoid a situation where a manually fed recording sheet 31 is present on the shared conveying path 22 for a prolonged period, the image memory 45 becomes unable to store all of the received image information, the received fax image recording operation instructing device 44 is not able to receive the transmitted fax image information, and the reception of the fax image information is interrupted.

Also, according to the present process, since the manually fed recording sheet 31 is not forcibly discharged from the manual feed port 12 when there is a PC print request or a copy print request ("YES" to the step S46 or S47), when the operator desires image recording on the manually fed recording sheet in printer mode or copy mode, it is possible to prevent the manually fed recording sheet 31 from being forcibly discharged from the manual feed port 12 without image recording having been carried out on the manually fed recording sheet in printer mode or copy mode.

Also, according to the present process, when the manually fed recording sheet 31 has been forcibly discharged from the manual feed port 12, the operator can be notified that the manually fed recording sheet 31 has been discharged. Therefore, the operator can know that the manually fed recording sheet 31 has been discharged and can be prevented from making erroneous operations.

Figure 6:
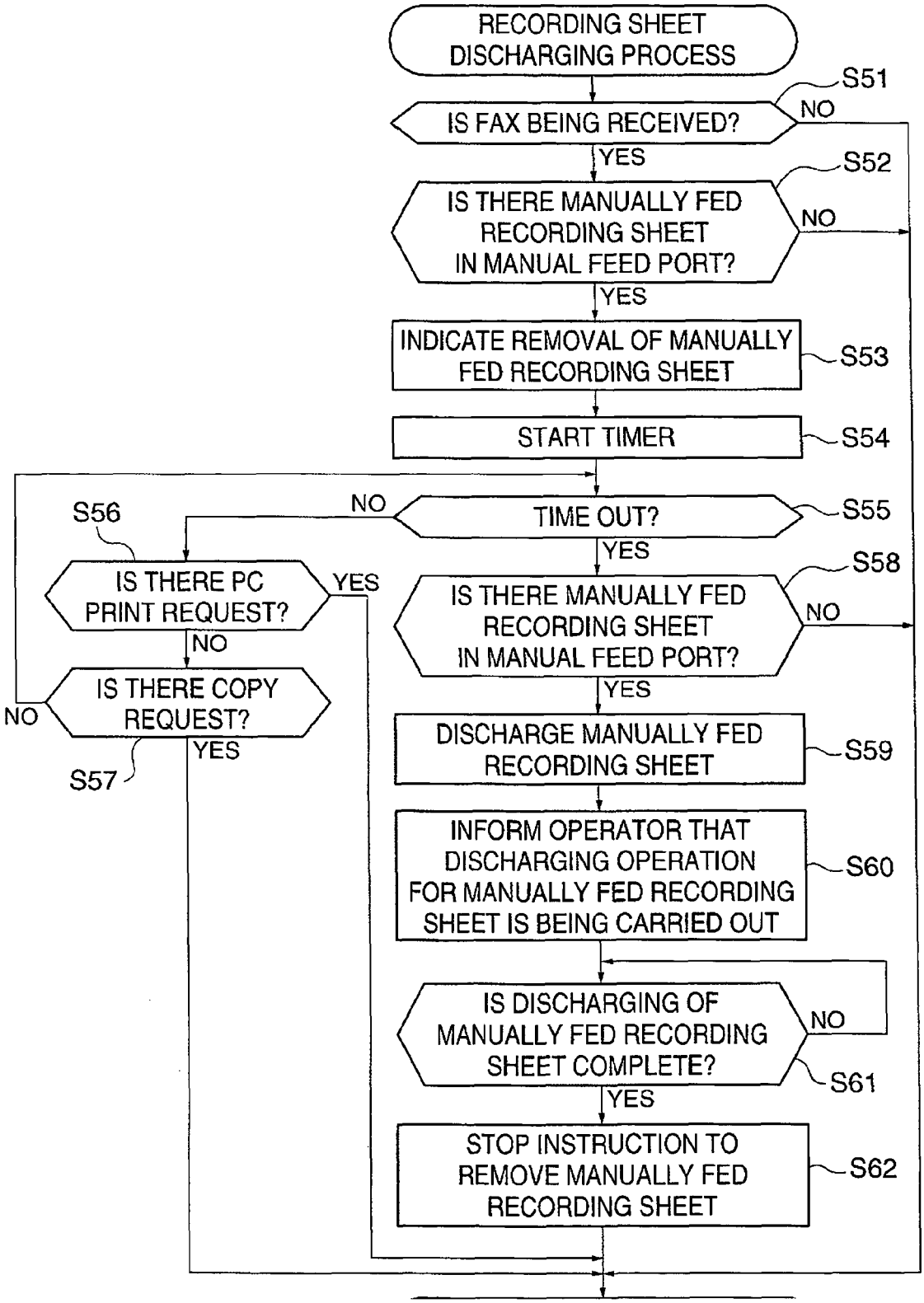
FIG. 6 is a flowchart showing the procedure of a fourth example of the recording sheet discharging process carried out by the MFP.

FIG. 6 is a flowchart showing the procedure of a fourth example of the recording sheet discharging process carried out by the MFP 1.

In the present process, in steps S51 to S59, the same processing as the steps S41 to S49 in the recording sheet discharging process shown in FIG. 5 described above is carried out.

In a step S60, after the operator has been notified that a manually fed recording sheet 31 is being discharged from the manual feed port 12, when the output from the manually fed recording sheet detecting sensor 18 becomes "OFF" and the discharging of the manually fed recording sheet 31 from the manual feed port 12 has been completed (step S61), the instruction to the operator to remove the manually fed recording sheet 31 from the manual feed port 12 is canceled (step S62) and the present process is terminated. Note that the operation storing an image into the image memory 45 and a recording operation for the stored images are carried out in the same way as in the third example.

According to the present process, it is possible to achieve the same effect as the process shown in FIG. 5 described above, and in addition, it is confirmed that the manually fed recording sheet 31 has been discharged from the manual feed port 12. Therefore, it is possible to reliably discharge the manually fed recording sheet 31 from the manual feed port 12.

Figure 7:
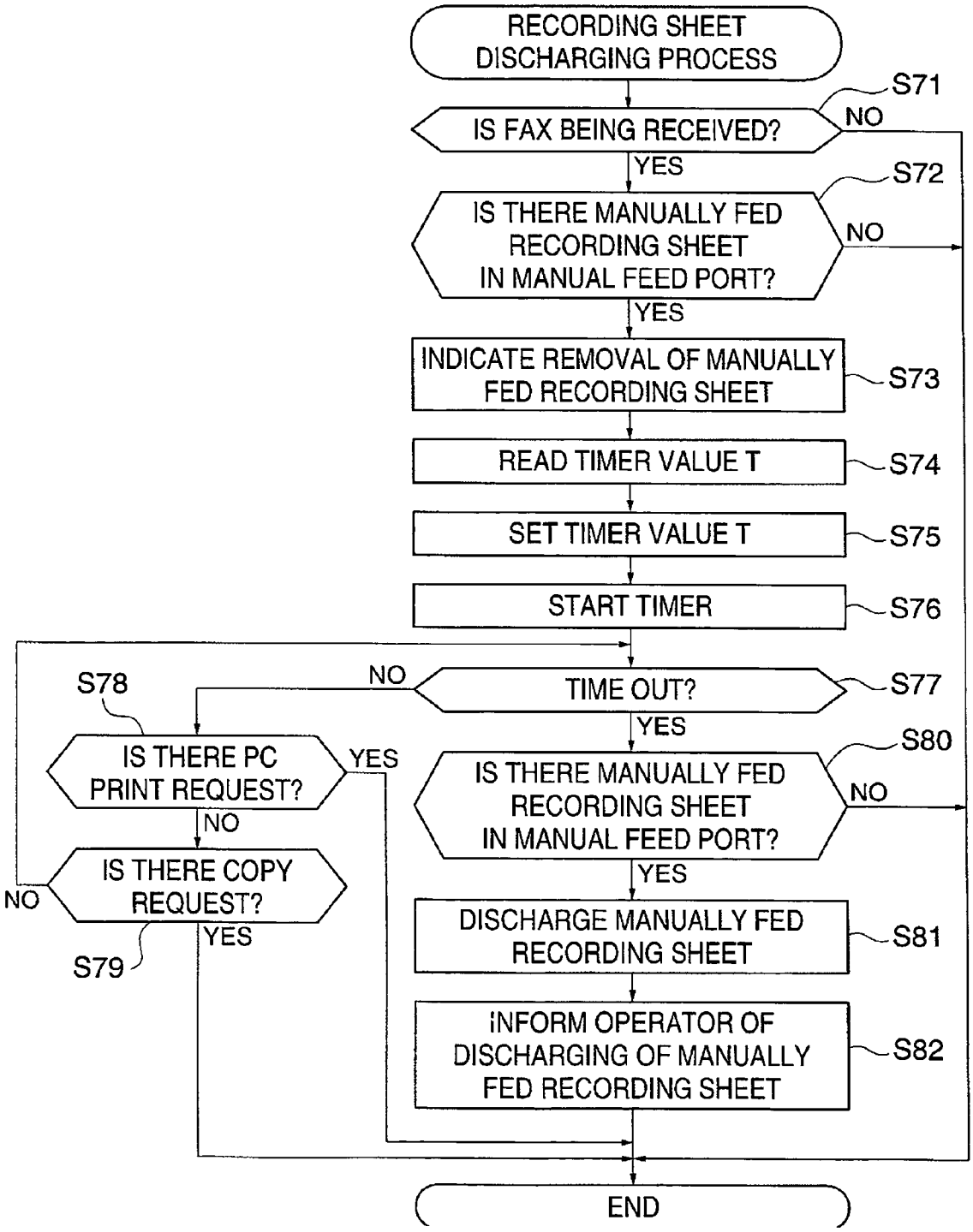
FIG. 7 is a flowchart showing the procedure of a fifth example of the recording sheet discharging process carried out by the MFP.

FIG. 7 is a flowchart showing the procedure of a fifth example of the recording sheet discharging process carried out by the MFP 1.

In the present process, in steps S71 to S73, the same processing as the steps S41 to S43 in the recording sheet discharging process shown in FIG. 5 is carried out. Next, a timer value T stored in a storage device, not shown, of the main controller 46 is read (step S74), the read timer value T is set to a count value of the timer described above (step S75), the timer is activated to start counting of time (step S76). Note that the timer value may be set in advance e.g. by the operator and the timer value T may take a plurality of values.

Next, in the same way as the processing in the step S44 in FIG. 5, it is determined whether the timer has counted up the timer value T and reached zero, thereby causing a time out (step S77). In steps S77 to S82, the same processing as the steps S45 to S50 in FIG. 5 is carried out. Note that the operation storing an image into the image memory 45 and a recording operation for the stored images are carried out in the same way as the third example.

According to the present process, the same effect as the process shown in FIG. 5 described above can be achieved and the count value of the timer can be set at an arbitrary timer value T. Therefore, it is possible for the operator to set the time period before the manually fed recording sheet 31 is forcibly discharged from the manual feed port 12 to a desired value, and thus it is possible to prevent the manually fed recording sheet 31 from being forcibly discharged when the operator does not desire discharging of the manually fed recording sheet 31.

Figure 8A:
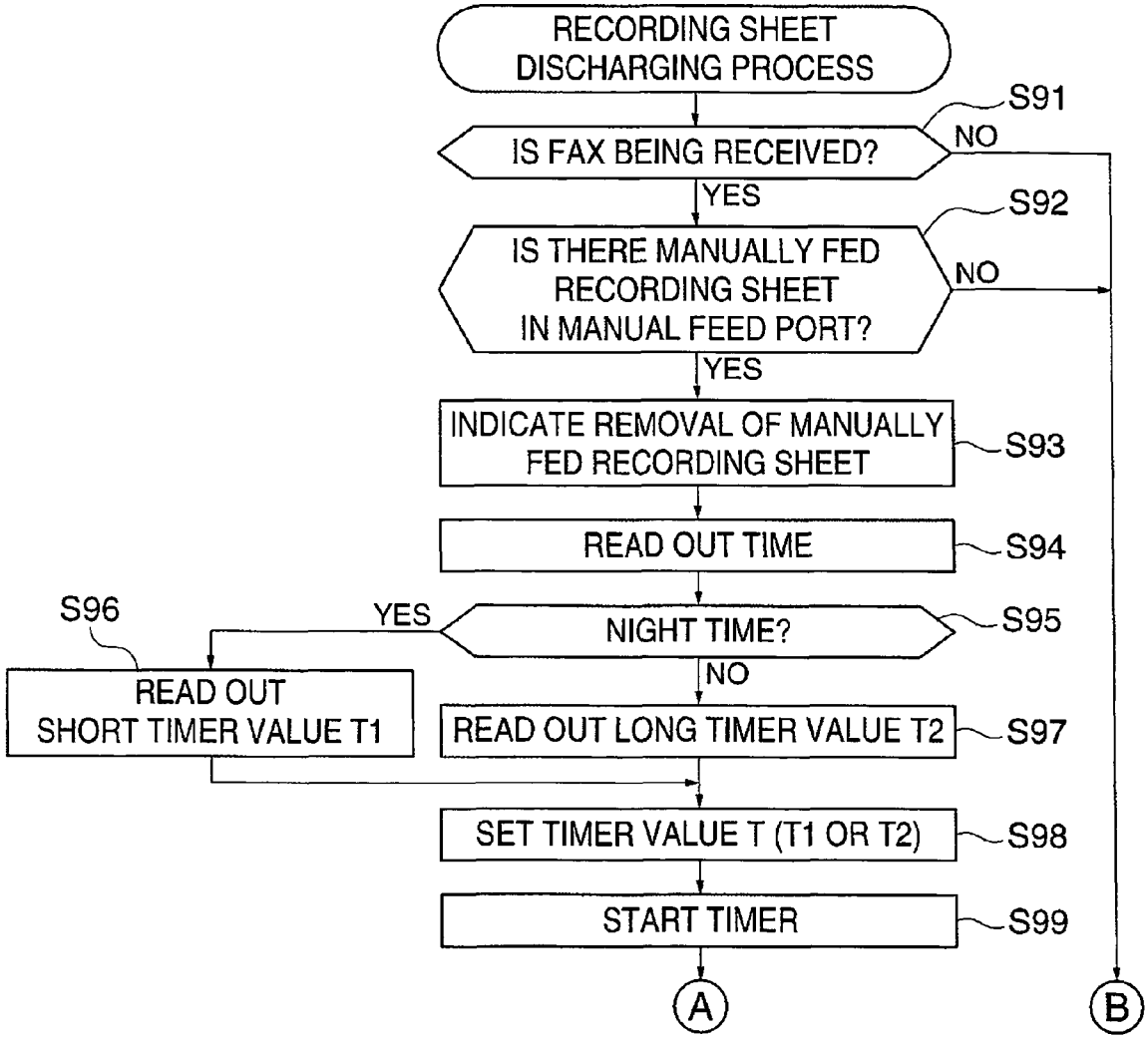
FIGS. 8A and 8B are flowcharts showing the procedure of a sixth example of the recording sheet discharging process carried out by the MFP.
Figure 8B:
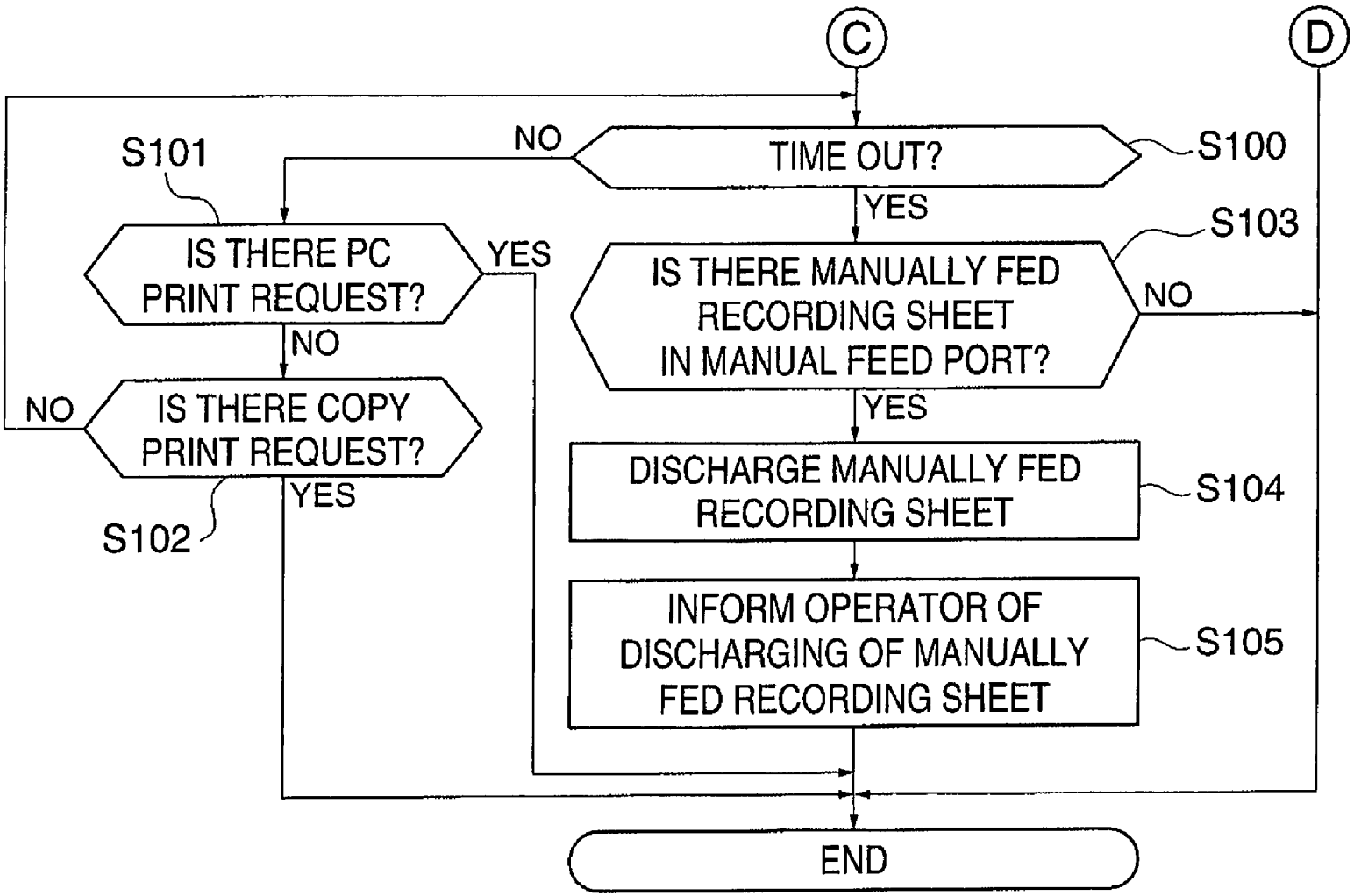

FIGS. 8A and 8B are flowcharts showing the procedure of a sixth example of the recording sheet discharging process carried out by the MFP 1.

In the present process, in steps S91 to S93, the same processing as the steps S41 to S43 in the recording sheet discharging process shown in FIG. 5 is carried out. Next, a clock, not shown, provided in the main controller 46 is referred to, the present time is read out (step S94), and it is determined whether the present time is during the night (step S95). The determination as to whether the present time is during the night is carried out by determining whether the present time satisfies a condition shown in Expression (1) below. If the condition in Expression (1) is satisfied, it is determined that the present time is during the night.

$$10\ \text{PM} \leqq \text{read time} \leqq 3\ \text{AM} \tag{1}$$

Next, based on the determination result of the step S95, a timer value that is one of a short timer value T1 and a long timer value T2 stored in the storage device, not shown, of the main controller 46 as the timer value T is selected and read out. The short timer value T1 is set at a short time period and the long timer value T2 is set at a longer time period than the short timer value T1 (i.e., T2>T1). More specifically, when in the step S95, the present time is during the night, the short timer value T1 is read (step S96), while when the present time is not during the night, the long timer value T2 is read (step S97).

Next, the short timer value T1 or the long timer value T2 read in the step S96 or the step S97 is set to the timer value of the timer (see the step S44 in FIG. 5) described above (step S98), the timer is activated to start counting of time (step S99). Next, in steps S100 to S105, the same processing as the steps S77 to S82 in FIG. 7 and the steps S45 to S50 in FIG. 5 is carried out. Note that the operation storing an image into the image memory 45 and a recording operation for the stored images are carried out in the same way as in the third example.

According to the present process, the same effect as the process shown in FIG. 5 described above can be achieved, and in addition, the timer value is set to the short timer value T1 during the night and the timer value is set to the long timer value T2 that is longer than the short timer value T1 when it is not night. Therefore, by setting the delay time until the manually fed recording sheet 31 is forcibly discharged from the manual feed port 12 to a shorter value during the night when the probability of image recording of a PC image in printer mode or image recording for an original image in copy mode is low, it is possible to carry out image recording of fax images in fax mode more quickly.

Figure 9A:
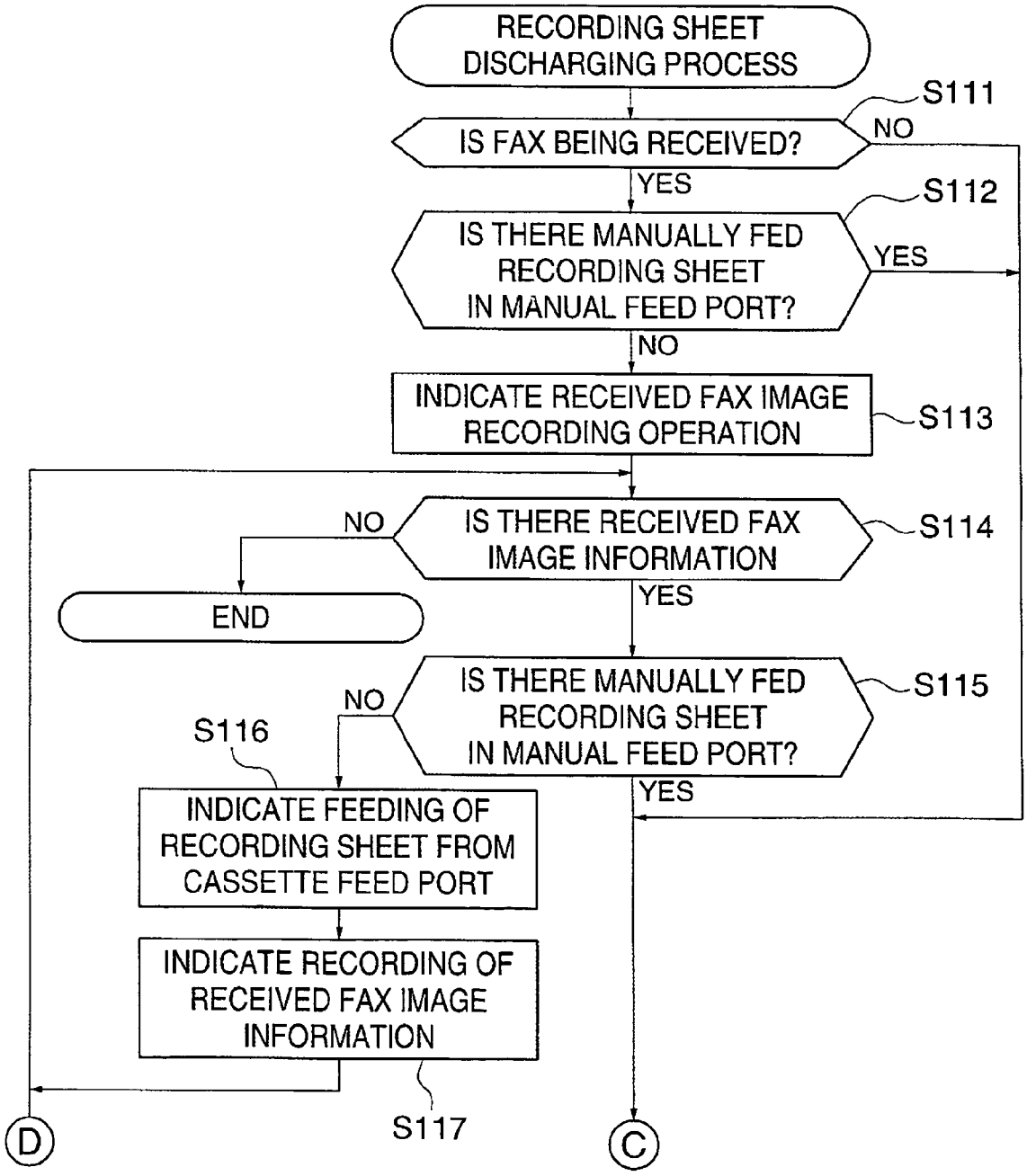
FIGS. 9A and 9B are flowcharts showing the procedure of a seventh example of the recording sheet discharging process carried out by the MFP.
Figure 9B:
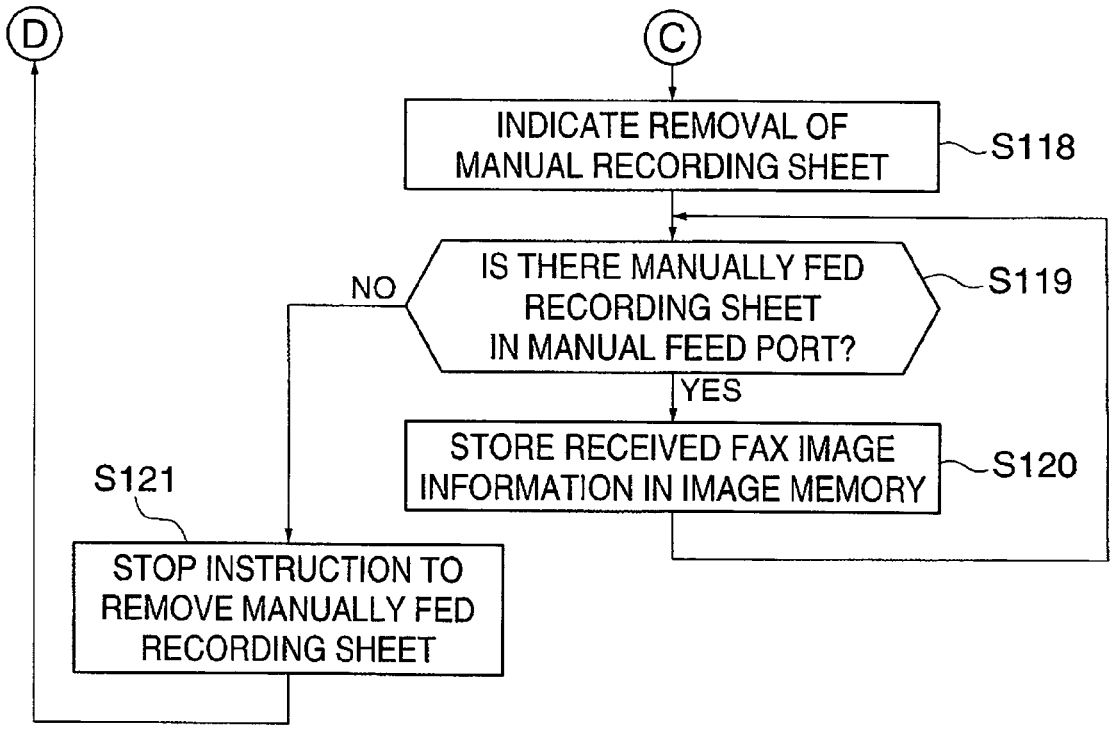

FIGS. 9A and 9B are flowcharts showing the procedure of a seventh example of the recording sheet discharging process carried out by the MFP 1.

First, the received fax image recording operation instructing device 44 determines whether fax image information is being received from the facsimile machine 63 (step S111). When no fax image information is being received from the facsimile machine 63, the present process is terminated. On the other hand, when fax image information is being received, in the same way as in the step S2 in FIG. 3, it is determined whether a manually fed recording sheet 31 has been inserted into the manual feed port 12 (step S112). When a manually fed recording sheet 31 is inserted into the manual feed port 12, processing in a step S118 onwards, described later, is carried out. On the other hand, when no manually fed recording sheet 31 has been inserted into the manual feed port 12, the received fax image recording operation instructing device 44 is instructed to carry out a received fax image recording operation (step S113).

Next, the received fax image recording operation instructing device 44 determines whether there is fax image information that has been received from the facsimile machine 63 (step S114), and when there is no fax image information, the present process is terminated. On the other hand, when there is received fax image information, in the same way as the step S2 in FIG. 3, it is determined whether a manually fed recording sheet 31 has been inserted into the manual feed port 12 (step S115). When no manually fed recording sheet 31 has been inserted into the manual feed port 12, the recording device 47 is instructed to feed cassette-fed recording sheets 32 from the cassette feed port 13 (step S116), the cassette feeding roller 20 is driven to feed cassette-fed recording sheets 32 from the cassette feed port 13. Next, the recording device 47 is instructed to record fax received images corresponding to the fax received image information onto the fed cassette-fed recording sheets 32 (step S117). In accordance with the instruction in the step S117, the recording device 47 starts a write operation of the image data on the photosensitive drum 15 and the like.

When the recording of a first page of received fax images is completed by carrying out the above operation, the process returns to the step S114, wherein it is determined whether there is received fax image information corresponding to the next page. The processing in the steps S114 to S117 is repeatedly carried out until the received fax image corresponding to the final page is recorded. The processing in the steps S114 to S117 is carried out to deal with the case where a manually fed recording sheet 31 is set in the manual feed port 12 while fax images are being recorded on the cassette-fed recording sheets 32 as described later.

On the other hand, when the manually fed recording sheet 31 has been inserted into the manual feed port 12 in the step S115, the recording of the received fax images is stopped and information indicating that the manually fed recording sheet 31 should be removed is displayed on the operation panel 48 (the step S118). That is, the operator is instructed to remove the manually fed recording sheet 31 from the manual feed port 12. Next, the received fax image information is stored in the image memory 45 (step S119 and step S120). When the manually fed recording sheet 31 has been removed from the manual feed port 12 ("NO" to the step S119), the instruction to the operator to remove the manually fed recording sheet 31 from the manual feed port 12 carried out in the step S118 is canceled (step S121), the process returns to the step S114, and the recording of the received fax image information that was stopped in the step S118 is resumed. That is, the recording of the received images stored in the image memory 45 is resumed.

In the process described above, when in the step S117, the fax image of the fax image information for the final page has been recorded, this means that there is no received fax image information in the step S114, and accordingly the present process is terminated.

According to the present process, when the received fax image recording operation instructing device 44 carries out an image recording operation in fax mode, it is determined for every page of fax images whether a manually fed recording sheet 31 is present on the shared conveying path 22, and when a manually fed recording sheet 31 is present, the operator is instructed to remove the manually fed recording sheet 31 from the manual feed port 12, with a fax image of the following page not being recorded until the manually fed recording sheet 31 is removed. Therefore, the operator can surely recognize that a manual fed recording sheet 31 has been inserted into the manual feed port 12, making it possible to reduce the risk of the image memory 45 becoming full and thereby unable to store the received image information.

As a result, it is possible to reduce the probability of a manually fed recording sheet 31 being present on the shared conveying path 22 for a prolonged period, the image memory 45 becoming unable to store all of the received image information, and the reception of the fax image information by the received fax image recording operation instructing device 44 being interrupted.

Figure 10A:
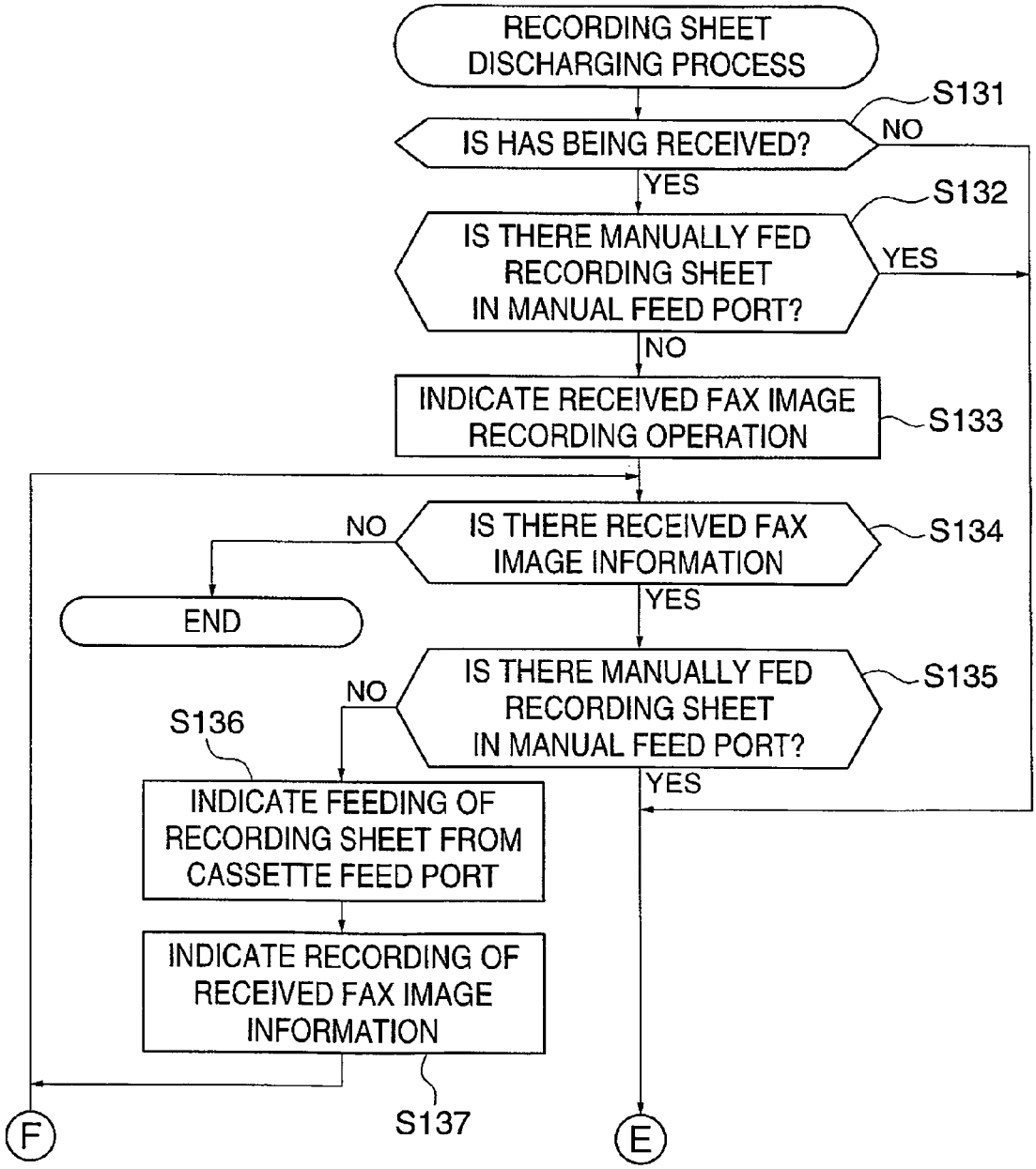
FIGS. 10A and 10B are flowcharts showing the procedure of an eighth example of the recording sheet discharging process carried out by the MFP.
Figure 10B:
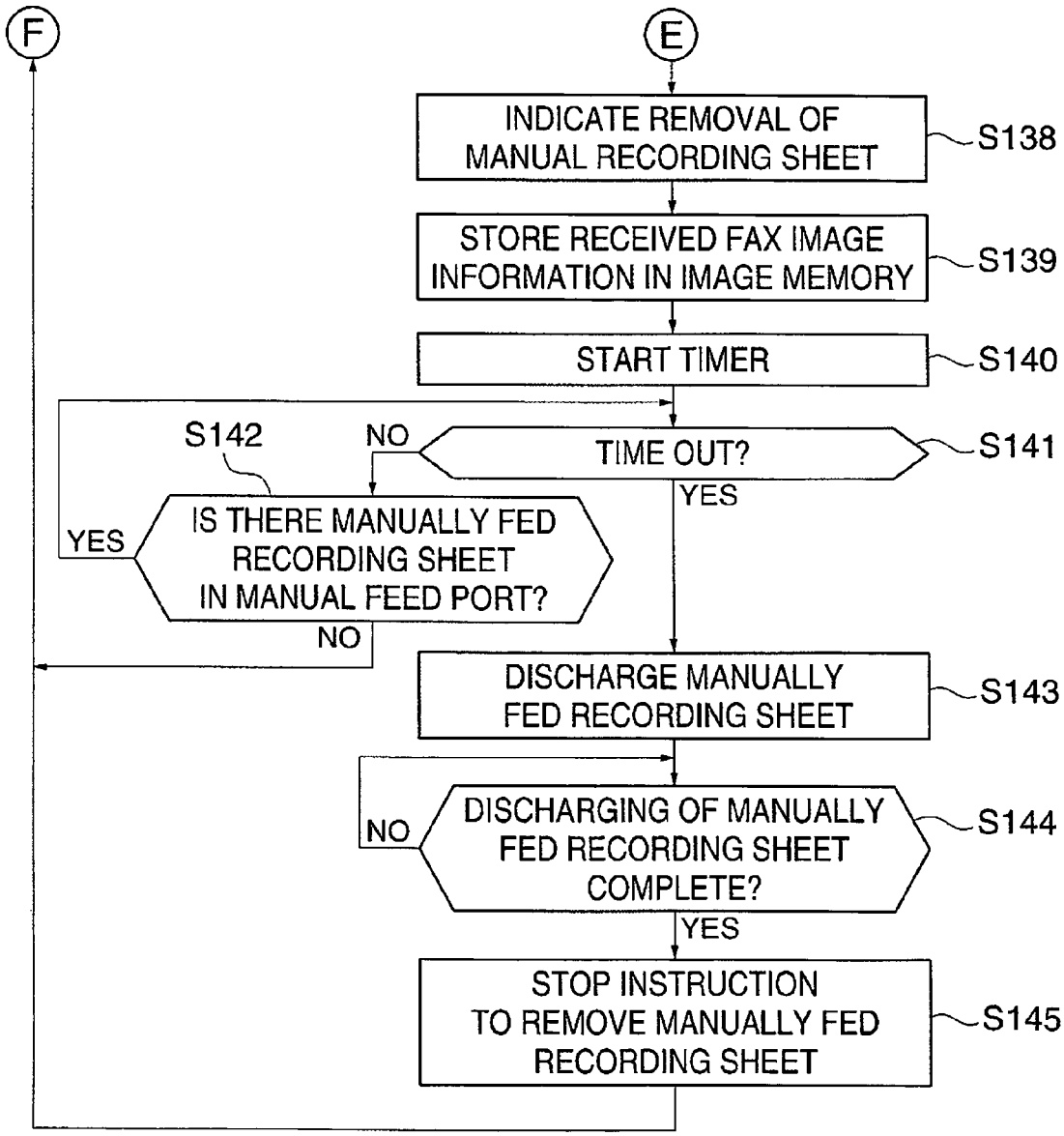

FIGS. 10A and 10B are flowcharts showing the procedure of an eighth example of the recording sheet discharging process carried out by the MFP 1.

In the present process, in steps S131 to S138, the same processing as the steps S111 to S118 in the recording sheet discharging process shown in FIGS. 9A and 9B described above is carried out. Next, in a step S139, the received fax image information is stored in the image memory 45, the timer described above is activated to start counting of time (step S140), and it is determined whether a time out has occurred for the timer (step S141). Next, until a time out occurs for the timer, it is determined whether the manually fed recording sheet 31 has been removed from the manual feed port 12 (step S142). The processing in the steps S141 and S142 is repeated until the manually fed recording sheet 31 is removed from the manual feed port 12. On the other hand, when the manually fed recording sheet 31 has been removed from the manual feed port 12, the process returns to the step S134.

On the other hand, when a time out has occurred in the step S141, the conveying rollers 17 are rotated in reverse to discharge the manually fed recording sheet 31 from the manual feed port 12 (step S143), the output from the manually fed recording sheet detecting sensor 18 becomes "OFF", and when the discharging of the manually fed recording sheet 31 from the manual feed port 12 has been completed (step S144), the instruction to the operator to remove the manually fed recording sheet 31 from the manual feed port 12 given in the step S128 is canceled (step S145), and the process returns to the step S134.

According to the present process, it is possible to achieve the same effect as the seventh example described above, and in addition, when a manually fed recording sheet 31 is set in the manual feed port 12, the manually fed recording sheet 31 is not forcibly removed from the manual feed port 12 until a predetermined time period has elapsed. Therefore, when the operator wishes to have image recording carried out on a manually fed recording sheet in printer mode or copy mode, it is possible to suppress the forcible discharging of the manually fed recording sheet 31 from the manual feed port 12 without image recording being carried out on the manually fed recording sheet in printer mode or copy mode.

The MFP 1 also includes a process enable/disable switch 52 that can enable or disable the recording sheet discharging processes in FIGS. 3 to 10B described above. When the process enable/disable switch 52 is on, the recording sheet discharging processes in FIGS. 3 to 10B are enabled, and when the process enable/disable switch 52 is off, the recording sheet discharging processes in FIGS. 3 to 10B are disabled.

Figure 11:
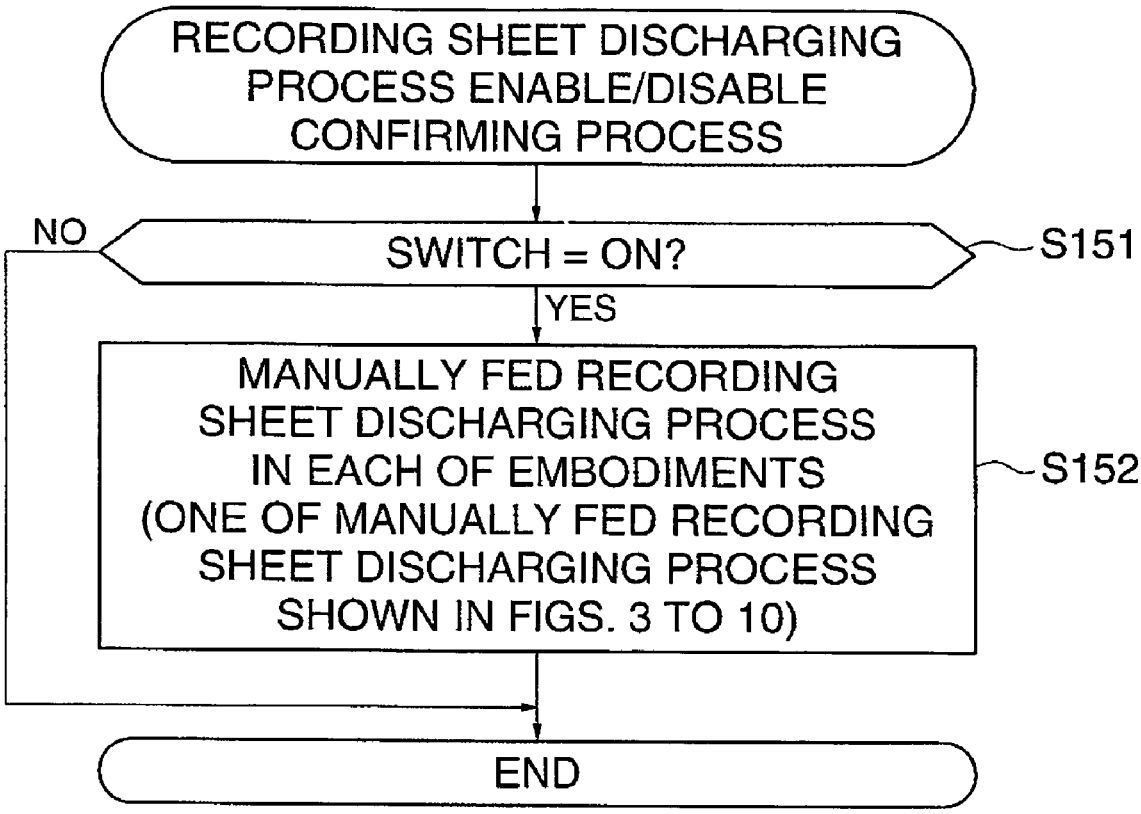
FIG. 11 is a flowchart showing the procedure of a recording sheet discharging process enable/disable confirming process carried out by the MFP.

That is, in the main controller 46 of the MFP 1, a recording sheet discharging process enabled/disabled confirming process shown in FIG. 11 that enables or disables the recording sheet discharging processes in FIGS. 3 to 10B is carried out. First, in a step S151, it is determined whether the process enable/disable switch 52 described above is on, and when the process enable/disable switch 52 is on, the recording sheet discharging process is carried out in a step S152. That is, in each of the first to eighth examples, a corresponding one of the recording sheet discharging processes in FIGS. 3 to 10B is carried out. On the other hand, when the process enable/disable switch described above is off in the step S151, the recording sheet discharging process is not executed. That is, in each of the first to eighth examples, the corresponding one of the recording sheet discharging processes in FIGS. 3 to 10B is not executed.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read out from the storage medium realizes the functions of the embodiment described above, and hence the program code and the storage medium in which the program code is stored constitute the present invention.

Examples of the storage medium for supplying the program code include a floppy (registered trademark) disk, a hard disk, a magneto-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of the embodiment may be accomplished not only by executing a program code read out by a computer, but also by causing an OS (operating system) or the like which operates on the computer to perform a part or all of the actual operations based on instructions of the program code.

Further, it is to be understood that the functions of the embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

This application claims priority from Japanese Patent Application No. 20-04-329790 filed Nov. 12, 2004, which is hereby incorporated by reference herein.

What is claimed is:

1. A recording apparatus including a facsimile receiving function and a copy function, comprising:

a first sheet feeding section that to which a sheet is manually fed;

a second sheet feeding section that feeds a recording sheet from a cassette that stores a plurality of recording sheets;

a shared sheet conveying section in which a manually fed sheet from said first sheet feeding section and a sheet fed from said second sheet feeding section are conveyed, said shared sheet conveying section including a holding function that holds the manually fed sheet from said first sheet feeding section and not capable of conveying the sheet fed from said second sheet feeding section in a state where the sheet fed from said first sheet feeding section is being held;

a sensor that detects whether the manually fed sheet is being held on said shared sheet conveying section;

an image forming section that forms images on the manually fed sheets from said first sheet feeding section or the sheet fed from said second sheet feeding section;

a memory operable when image formation by said image forming section is not possible for an image received by the facsimile receiving function, to store the received image;

a warning section operable when said sensor detects that the manually fed sheet from said first sheet feeding section is being held on said shared sheet conveying section when image formation for the image received by the facsimile receiving function is to be carried out on a sheet stored in said second sheet feeding section, to give to an operator a warning so as to have the held manually fed sheet removed;

a control section that determines whether or not a request of executing the copy function has been received after the warning section has given to the operator the warning, and subsequently causes said image forming section to carry out the image forming on the held manually fed sheet subjected to the warning so as to be removed in accordance with a determination that the request of executing the copy function has been received, and causes the warning section to continue giving the warning in accordance with a determination that the request of executing the copy function has not been received; and a discharge control section operable, when the manually fed sheet held in said shared sheet conveying section has not been removed after the warning was given by said warning section, to discharge the held manually fed sheet forcibly, wherein said control section causes the discharge control section to prevent forcible discharging of the held manually fed sheet in accordance with a determination that the request of executing the copy function is received by the control section, and wherein said discharge control section is operable in accordance with the manually fed sheet held in said shared sheet conveying section having not been removed after a predetermined time period has elapsed following the warning given by said warning section, to discharge the held manually fed sheet forcibly.

2. A recording apparatus according to claim 1, further comprising a recording control section operable in accordance with detection by said sensor detects that the manually fed sheet has been removed from said shared sheet conveying section, to have image formation commenced for the received image stored in said memory.

* * * * *